US005715538A

United States Patent [19]

Soll

[11] Patent Number: 5,715,538

[45] Date of Patent: Feb. 10, 1998

[54] METHOD OF SECURING A NECKTIE TO A SHIRT FRONT AND DEVICE THEREFOR

[76] Inventor: David B. Soll, 5001 Frankford Ave., Philadelphia, Pa. 19124

[21] Appl. No.: 708,522

[22] Filed: Sep. 5, 1996

[51] Int. Cl.[6] ..... A41D 25/00

[52] U.S. Cl. ..... 2/145; 2/144; 2/156; 24/49.1; 24/66.1; 24/66.4

[58] Field of Search ..... 2/144, 145, 146, 2/148, 149, 150, 152.1, 153; 24/49.1, 50, 52, 53, 59, 62, 64, 65, 66.1, 66.2, 66.4, 66.8, 66.9

[56] References Cited

U.S. PATENT DOCUMENTS 1,209,508 12/1916 Spelling ..... 2/52
1,482,560 2/1924 Hewes ..... 2/145
1,692,043 11/1928 Kremski et al. ..... 2/145 X
3,405,408 10/1968 Baker ..... 2/145
3,453,696 7/1969 Mates ..... 24/66.1

*Primary Examiner*—Jeanette E. Chapman
*Attorney, Agent, or Firm*—Panitch Schwarze Jacobs & Nadel, P.C.

[57] ABSTRACT

A necktie securing device for securing to a shirt front a necktie having a tail, an apron and a label, the label being attached to a rear surface of the apron, to a shirt front when the tail is disposed within an opening formed by the label and the apron, includes a first clip demountably attachable to the tail and having a first VELCRO material covered joining surface and a second clip demountably attachable to an overlapping edge of the shirt front and having a second joining surface covered by complementary VELCRO material, the second joining surface of the second clip being engageable with the first joining surface of the first clip.

4 Claims, 3 Drawing Sheets

METHOD OF SECURING A NECKTIE TO A SHIRT FRONT AND DEVICE THEREFOR

FIELD OF THE INVENTION

The present invention relates to a device for securing a necktie to a shirt front.

BACKGROUND OF THE INVENTION

A number of devices for securing a necktie to the front of a shirt are known. Generally, these devices operate by attaching a first portion of the device to the shirt front and a second portion of the device to the necktie, so that the necktie is secured to the shirt front. The first and second portions of the device are either an integral unit, so that the necktie is always secured to the shirt when the device is attached, or are comprised of two separate and different members which are engageble to secure the necktie to the shirt. An example of the first type would be the "Buttonslot Necktie Fastener" disclosed in U.S. Pat. No. 4,827,576 and an example of the second type is the "Necktie Holder" disclosed in U.S. Pat. No. 3,453,696.

All of the prior art devices for securing a necktie to a shirt front have at least one of the following several disadvantages. Many of the devices, such as the "Necktie Holder" disclosed in U.S. Pat. No. 3,453,696, require that a portion of the device be permanently or semi-permanently attached to either the shirt front and/or the necktie, and thus are not readily removable from both the shirt front and the necktie and do not allow easy adjustment of the location of the device on the shirt front or necktie. For example, the Necktie Holder of U.S. Pat. No. 3,453,696 requires that a strip of VELCRO material be attached to the back of the tie by stitching or an adhesive. Another disadvantage of some of the prior art devices is that the devices cause some permanent damage to the necktie. For example, U.S. Pat. No. 1,960,145 discloses a device in which "prongs" are "driven through the fabric" of the necktie in order to secure a clasping device to the necktie. Yet another disadvantage of some of these devices is that the device can only be utilized at a limited number of locations on the shirt front and/or the necktie. For example, the device disclosed in U.S. Pat. No. 4,835,521 can be utilized only at one or two locations between adjacent buttons on a shirt front which are near the label of the necktie when the necktie rests against the shirt front, as the label secures one portion of the device to the necktie. A further disadvantage with some prior art necktie holding devices is that the device is built-in to the necktie, and thus a special necktie must be purchased. For instance, U.S. Pat. Nos. 2,746,055, 5,905,546 and 5,239,707 all have a securing means built into the necktie.

The present invention provides a simple, inexpensive device for securing a necktie to a shirt front which does not require a special necktie, is not permanently attached to the necktie and does not mar or damage the necktie when secured thereto. In addition, the device of the present invention secures the necktie along any number of portions of the shirt front, and is not limited to only being located proximate to a button.

SUMMARY OF THE INVENTION

Briefly stated, in a first aspect, the present invention is a necktie securing device for securing to a shirt front a necktie having a tail, an apron and a label, the label being attached to a rear surface of the apron, when the tail is disposed within an opening formed between the label and the apron.

The device is comprised of a first clip demountably attachable to the tail and having a first joining surface and a second clip demountably attachable to an overlapping edge of the shirt front and having a second joining surface, the second joining surface of the second clip being engageable with the first joining surface of the first clip.

In a second aspect, the invention is a first method for securing to a shirt front a necktie having an apron, a tail and a label, the label being attached to a rear surface of the apron. The method comprises the steps of disposing the tail within an opening formed between the label and the apron such that the tail is attached to the apron, attaching a first clip having a first joining surface to the tail, attaching a second clip having a second joining surface to an overlapping edge of the shirt front and engaging the first joining surface of the first clip with the second joining surface of the second clip, thereby securing the necktie to the shirt front.

In a third aspect, the invention is a second method for securing a necktie having the above cited elements to a shirt front which is substantially identical to the first method, except that the first clip is attached to the label of the necktie.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings, which are diagrammatic, embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
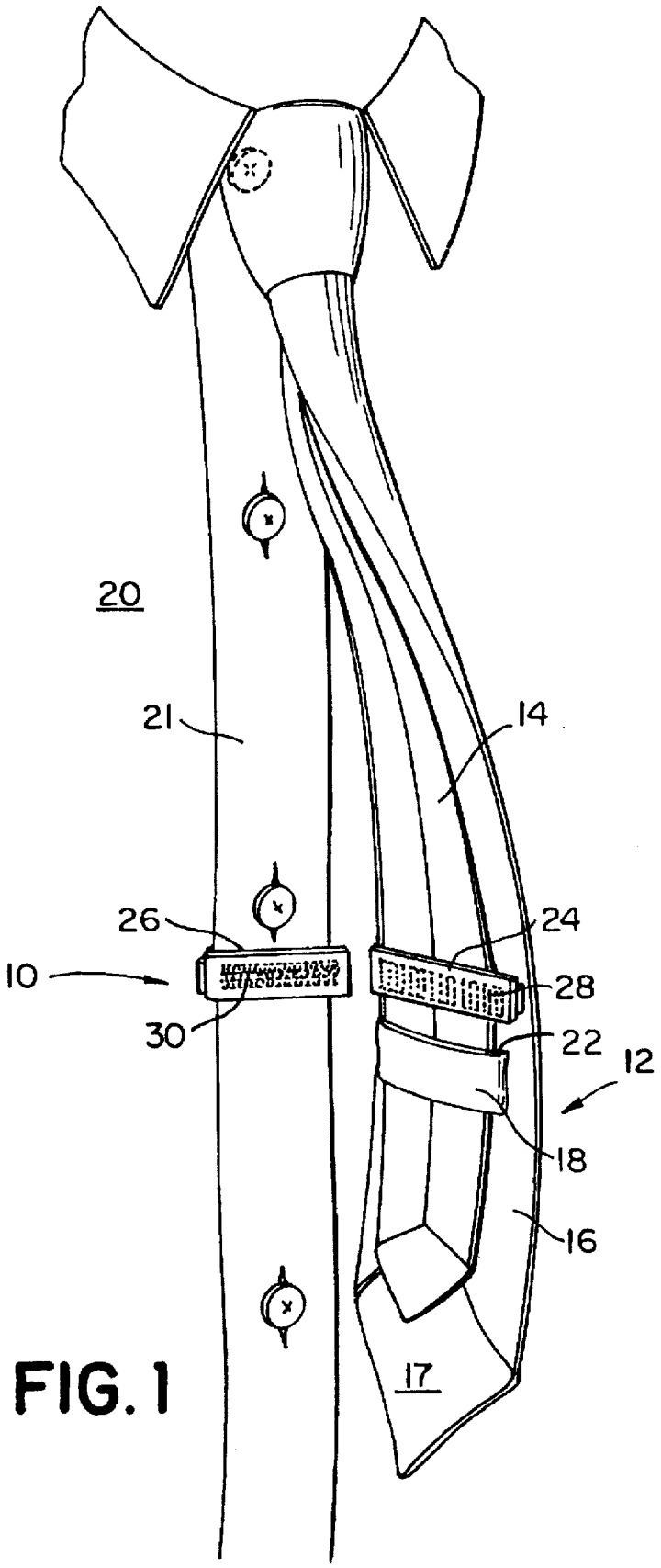
FIG. 1 is a perspective view of a necktie securing device in accordance with a first embodiment of the present invention, shown attached to a necktie and a shirt and in a disengaged configuration.

Certain terminology is used in the following description for convenience only and is not limiting. The words "right", "left", "front", "rear", "lower" and "upper" designate directions in the drawings to which reference is made. The words "inner" and "outer" refer to directions toward and away from, respectively, a center of a clip of the present invention. The terminology includes the words above specifically mentioned, derivatives thereof and words of similar import.

Referring now to the drawings in detail, wherein like numerals are used to indicate like elements throughout, there is shown in FIGS. 1–6 a first preferred embodiment of a necktie securing device 10 for securing a necktie 12 to a shirt front 20. The necktie 12 includes a tail 14, an apron 16 and a label 18. The label 18 is attached to a rear surface 17 of the apron 16. An opening 22 is formed between the label 18 and the apron 16. As is known, when the necktie 12 is worn, the tail 14 is passed through the opening 22 formed between the label 18 and the rear surface 17 of the apron 16 such that the tail 14 is coupled to the apron 16.

The necktie securing device 10 generally comprises a first clip 24 and a second clip 26. The first clip 24 is demountably attachable to the tail 14 of the necktie 12 and has a first joining surface 28. The second clip 26 is demountably attachable to an overlapping edge 21 of the shirt front 20 and has a second joining surface 30. The second joining surface 30 of the second clip 26 is engageable with the first joining surface 28 of the first clip 24, as is described in detail below to removably secure the first clip 24 to the second clip 26. The first clip 24 and the second clip 26 are hidden from view when in an operative position.

Figure 2:
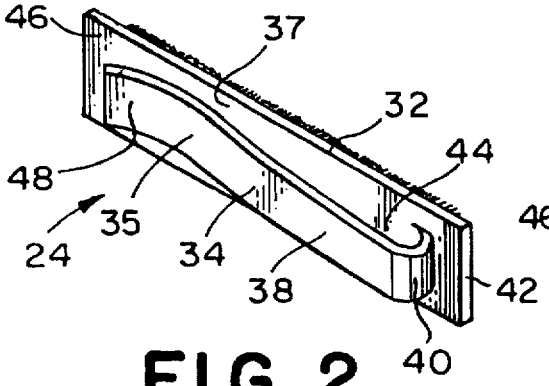
FIG. 2 is a perspective view of a first clip in accordance with the first embodiment of the present invention, shown from the rear.
Figure 3:
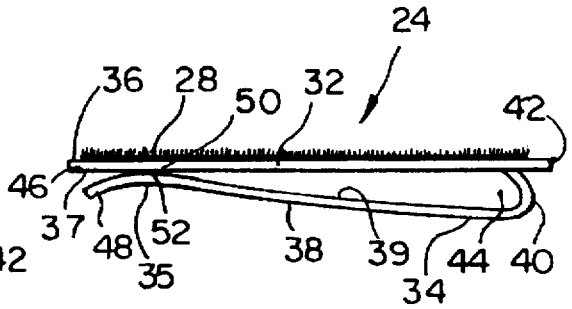
FIG. 3 is a top plan view of the first clip of FIG. 2.

Referring to FIGS. 2 and 3, the first clip 24 is constructed as a spring clip having a first prong 32 and a second prong 34. The first prong 32 is preferably constructed as a substantially flat, generally rectangular member having an outer surface 36 and an inner surface 37. The first joining surface 28 is preferably located on the outer surface 36 of the first prong 32. The second prong 34 is constructed as a generally rectangular member including a bend 35 and having an outer surface 38 and an inner surface 39. Although both the first prong 32 and the second prong 34 preferably have a generally rectangular shape, it is within the scope of the present invention to construct either or both the first prong 32 and the second prong 34 as any other appropriate shape, such as, for example, partially cylindrical (not shown). It is well within the abilities of one skilled in the art to construct the first prong 32 and the second prong 34 of any shape which enables the first clip 24 to function as described below.

A joint 40 connects the first prong 32 to the second prong 34 so that the inner surface 39 of the second prong 34 is in facing relationship with the inner surface 37 of the first prong 32. Preferably, the second prong 34 is attached to the inner surface 37 of the first prong 32 with the joint 40 being disposed near a side edge 42 of the first prong 32, as shown in FIGS. 2 and 3. A space 44 in which the tail 14 of the necktie 12 is disposed is situated between the inner surface 37 of the first prong 32 and the inner surface 39 of the second prong 34.

The joint 40 transmits a biasing moment to the first prong 32 and the second prong 34 that tends to move an end 46 of the first prong 34 toward an end 48 of the second prong 34 and vice versa. The biasing moment is experienced at a grip section 50 of the inner surface 37 of the first prong 32 and at a grip section 52 of the inner surface 39 located at the bend 35 of the second prong 34 as a pair of normal forces exerted upon either the grip sections 50, 52 or upon an object, i.e. the tail 14, disposed between the grip sections 50, 52. When a portion of the necktie 12 is disposed within the space 44 between the first prong 32 and the second prong 32, the normal forces are exerted upon the section of the necktie 12 between the grip section 50 and the grip section 52. These normal forces generate frictional forces which act to prevent relative movement between each grip section 50, 52 and the particular surface of the necktie 12 on which the grip section 50, 52 is placed and resists external forces, such as gravity, so that the first clip 24 remains attached to the necktie 12. The joint 40 is preferably constructed so that the biasing moment is always present, which causes the grip section 50 of the first prong 32 and the grip section 52 of the second prong 34 to press into contact with each other. Alternatively, the joint 40 may be constructed so that the biasing moment does not arise until the end 46 of the first prong 32 and the end 48 of the second prong 34 are displaced away from each other. It is within the scope of the present invention to construct the first clip 24 to have any other two-pronged spring clip configuration or to utilize any other type of force or moment and the source thereof by which the first clip 24 is capable of demountably attaching to a necktie 12. It is well within the abilities of one skilled in the art to construct a first clip 24 having any other appropriate means for attaching to a necktie and utilizing any other forces or moments as may be necessary to the particular clip configuration. The present invention is intended to embrace all such alternative two-pronged spring clip configurations.

Preferably, as shown in FIGS. 1–6, the first prong 32, the second prong 34 and the joint 40 are constructed as integral parts of the first clip 24. With an integral construction of the first clip 24, the biasing moment described above is provided by the bending stresses arising in the material of joint 40, which either arise or are increased when the end 46 of the first prong 32 is displaced relative to the end 48 of the second prong 34. However, it is within the scope of the present invention to construct a first clip 24 having a first prong 32, a second prong 34 and a joint 40 which are three separate members (not shown) assembled together and including some means for generating a biasing moment, such as by providing a torsion spring (not shown) attached to the joint 40 and extending between the first prong 32 and the second prong 34.

Figure 5:
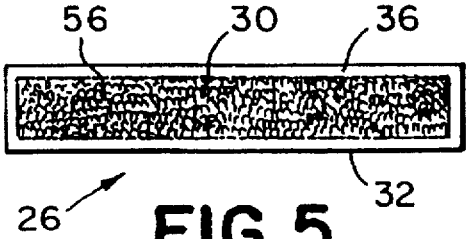
FIG. 5 is a front elevational view of the second clip, shown with loop elements on the mounting surface.
Figure 6:
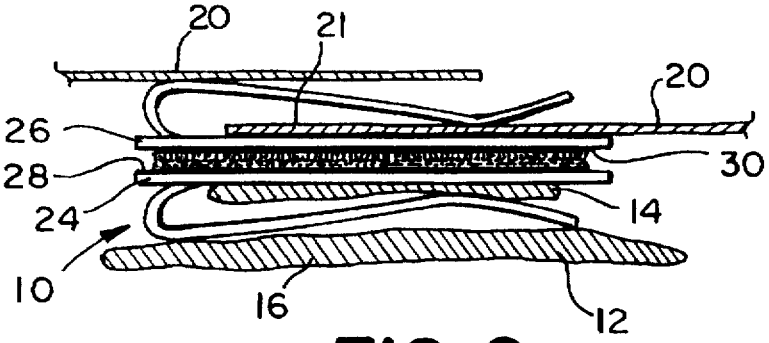
FIG. 6 is a top plan view of the necktie securing device in accordance with the first embodiment, shown in an engaged configuration.

Referring to FIGS. 1, 5 and 6, in the preferred embodiment of the present invention, the second clip 26 is substantially identically constructed as the first clip 24 with the differences discussed below. As previously discussed, the second joining surface 30 of the second clip 26 is releasably engageable with the first joining surface 28 of the first clip 24.

Figure 4:
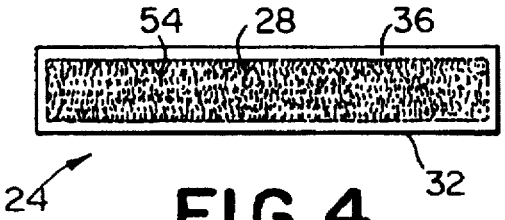
FIG. 4 is a front elevational view of the first clip, shown with hook elements on the mounting surface.

Referring to FIGS. 4 and 5, according to the present invention, the first joining surface 28 and the second joining surfaces 30 are releasably securable to each other. Preferably, either the first joining surface 28 of the first clip 24 or the second joining surface 30 of the second clip 26 includes a plurality of hook elements 54 and the remaining one of the first joining surface 28 or the second joining surface 30 includes a plurality of loop elements 56, with the hook elements 54 configured to engage the loop elements 56. It is within the scope of the present invention to either provide the first joining surface 28 of the first clip 24 with hook elements 54 and the second joining surface 30 of the second clip 26 with includes loop elements 56, as shown in FIGS. 5 and 6, or to provide the first joining surface 28 of the first clip 24 which includes loop elements 56 and the second joining surface 30 of the second clip 26 which includes hook elements 54.

Referring to FIG. 6, the necktie 12 is shown secured to the shirt front 20 by the first clip 24 and the second clip 26. That is, the necktie 12 is adorned with the tail 14 placed through the label 18. The first clip 24 is secured to the tail 14 of the necktie 12 and the second clip 26 is secured to the shirt front 20. The outer surface 36 of the first clip 36 and the outer surface 38 of the second clip 28 are in facing relationship such that the first joining surface 28 of the first clip 24 is releasably attached to the second joining surface 30 of the second clip 26 by placing the hook elements 54 into contact with the loop elements 56 and causing the hook elements 54 to engage and grasp the loop elements 56. The first joining surface 28 of the first clip 24 is detached from the second joining surface 30 of the second clip 26 by disengaging the hook elements 54 from the loop elements 56.

The arrangement of hook elements 54 and loop elements 56 is preferably provided by attaching a first strip of a material commercially available under the trademark "VELCRO" to the first joining surface 28 of the first clip 24 and a second strip of complementary VELCRO material to the second joining surface 30 of the second clip 26. Preferably, the first strip is attached to the first joining surface 28 by an adhesive material (not shown) and the second strip 60 is similarly attached to the second joining surface 30 by an adhesive material.

However, it is within the scope of the present invention to provide any other means for engaging the first joining surface 28 of the first clip 24 with the second joining surface 30 of the second clip 26. For example, the first clip 24 could include a first magnet (not shown) attached to the first joining surface 28 and the second clip 26 could include a second magnet (not shown) attached to the second joining surface 30 so that the two joining surfaces would be engageable with a magnetic force. Alternatively, bonding materials which are non-toxic and do not damage the material of the shirt front 20 or the necktie 12 which are detachably securable may also be used. The present invention is intended to embrace all other possible arrangements for engaging the first joining surface 28 with the second joining surface 30.

As discussed above, in the preferred embodiment of the present invention, the first clip 24 and the second clip 26 are identically constructed and sized with the exception of the complementary configuration of the hook elements 54 and the loop elements 56, as is shown in FIGS. 1, 5 and 6. Furthermore, it is preferred that each clip is capable of being interchanged with the other so that the first clip 24 could be demountably attached to an overlapping edge 21 of a shirt front 20 and the second clip 26 could be demountably attached to a necktie 12. However, it is within the scope of the present invention to construct any or all of the above-described elements of the first clip 24 differently than the corresponding elements of the second clip 26, so long as the first clip 24 and the second clip 26 are capable of functioning as described in this disclosure.

In the presently preferred embodiment of the necktie securing device 10, the first clip 24 and the second clip 26 are either constructed of a polymeric material in a process such as injection molding or are constructed of metal, such as steel by one or more manufacturing processes, such as stamping and four-slide die forming. However, it is within the scope of the present invention to construct the first clip 24 and the second clip 26 of any other appropriate material, such as, for example, aluminum, and to manufacture the first clip 26 and the second clip 26 by another appropriate manufacturing process. Furthermore, as discussed above, it is also within the scope of the present invention to construct either or both of the first clip 24 and the second clip 26 from multiple pieces or members (not shown).

As discussed above, the hook elements 54 and the loop elements 56 are preferably fabricated from strips of a commercially available material such as VELCRO, which is usually produced as woven strips of a synthetic material such as a superpolyamide, although a securing device utilizing another means for releasably engaging the first joining surface 28 with the second joining surface 30 would include such means constructed of appropriate materials, such as, for example, two ceramic permanent magnets.

The present invention further comprises a first method for securing a necktie 12 to a shirt front 20 comprising the following steps. First, after the necktie 12 is tied, the tail 14 is disposed within the opening 22 formed between the label 18 and the apron 16 such that the tail 14 is essentially attached to the apron 16. Next, the first clip 24 is attached to the tail 14 at a desirable location and the second clip 26 is attached to the edge 21 of the shirt front 20 at a location such that the second clip 26 is generally aligned with the first clip 24. The first clip 24 is attached to the tail 14 of the necktie 12 by disposing a portion of the tail 14 within the space 44 between the first prong 32 and the second prong 34, such that the tail 14 is secured therein by forces previously described. The second clip 26 is attached to the overlapping edge 21 of the shirt front 20 by disposing a portion of the overlapping edge 21 within the space 44 between the first prong 32 and the second prong 34 such that the shirt front 20 is secured therein by the forces previously described. Finally, the first joining surface 28 of the first clip 24 is engaged with the second joining surface 30 of the second clip 26, thereby securing the necktie 12 to the shirt front 20.

The first clip 24 and the second clip 26 are hidden from view by an observer when in an operative position. As is shown in FIG. 6, the necktie securing device 10 of the present invention is disposed behind the apron 16 of the necktie 12 when the first clip 24 is engaged with the second clip 26.

Preferably, as described above, one of the first joining surface 26 and the second joining surface 30 includes a plurality of hook elements 54 and a remaining one of the first joining surface 28 and the second joining surface 30 includes a plurality of loop elements 56, the hook elements 54 being configured to engage the loop elements 56. In this situation, the step of engaging the first joining surface 28 with the second joining surface 30 includes engaging the hook elements 54 or the loop elements 56 of the first joining surface 28 with the loop elements 56 or the hook elements 54 of the second joining surface 30.

Since the first clip 24 and the second clip 26 are securable to the shirt front 20 and the necktie 12 by spring force, the first clip 24 can be attached at one of a plurality of locations extending along the length of the tail 14 and the second clip 26 can be attached at one of a plurality of locations on the overlapping edge 21 of the shirt front 20. Note that the second clip 26 is not limited to being disposed proximate to a button on the shirt front 20.

The present invention further comprises a second method for securing a necktie 12 to a shirt front 20 which is substantially identical to the first method outlined above, with the following differences. As with the first method, first, the tail 14 is disposed within the opening 22 formed between the label 18 and the apron 16 such that the tail 14 is essentially attached to the apron 16. Next, the first clip 24 is attached to the label 18, rather than the tail 14, and the second clip 26 is attached to the edge 21 of the shirt front 20. The first clip 24 is attached to the label 18 of the necktie 12 by disposing a portion of the label 18 within the space 44 between the first prong 32 and the second prong 34, such that the label is secured therein by forces previously described.

When attached to the label 18, the first clip 24 extends primarily longitudinally with respect to the apron 16 and is in an orientation which is essentially a 90 degree rotation of the orientation of the first clip 24 in the first method. The second clip 26 is attached to the overlapping edge 21 of the shirt front 20 as described above. Finally, a section of the first joining surface 28 of the first clip 24 is engaged with a section of the second joining surface 30 of the second clip 26, thereby securing the necktie 12 to the shirt front 20. In the second method of securing a necktie 12 to a shirt front 20, the joining surface 28 of the first clip 24 extends substantially perpendicularly across the joining surface 30 of the second clip 26 and the area of engagement of the first joining surface 28 and the second joining surface 30 is smaller than the area of engagement of the joining surfaces in the first method.

The present invention further comprises a third method for securing the necktie 12 to the shirt front 20 which is similar to the first and second methods, with the following differences. First, the tail 14 is disposed within the opening 22 formed between the label 18 and the apron 16 such that the tail 14 is essentially attached to the apron 16. Next, the first clip 24 is attached to the either the label 18 or at a preferred position along the tail 14. Next, rather than attaching the second clip 26 to the edge 21 of the shirt front 20, the second clip 26 is attached to the first clip 24. Then, the second clip 26 is attached to the edge 21 of the shirt front 20. This allows the first and second clips 24, 26 to be aligned prior to attaching the second clip 26 to the shirt front 20, and thus ensuring a good alignment of the clips 24, 26.

Figure 7:
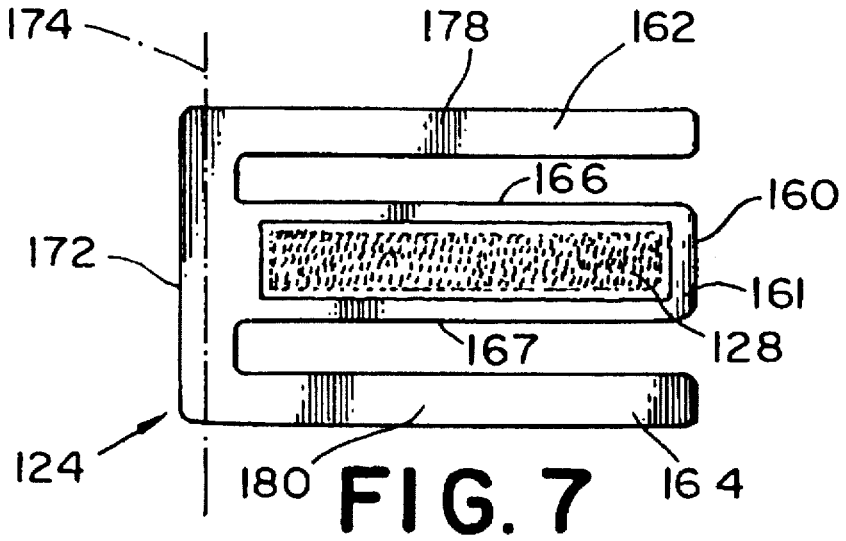
FIG. 7 is a front elevational view of the first clip in accordance with a second embodiment of the present invention.
Figure 8:
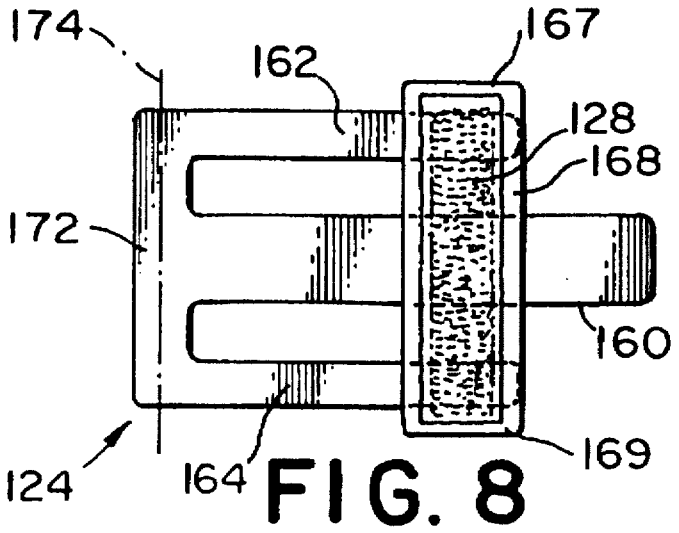
FIG. 8 is a front elevational view of the first clip in accordance with the second embodiment of the present invention, shown with an optional cross-member and illustrating an alternative configuration of the side prongs.
Figure 9:
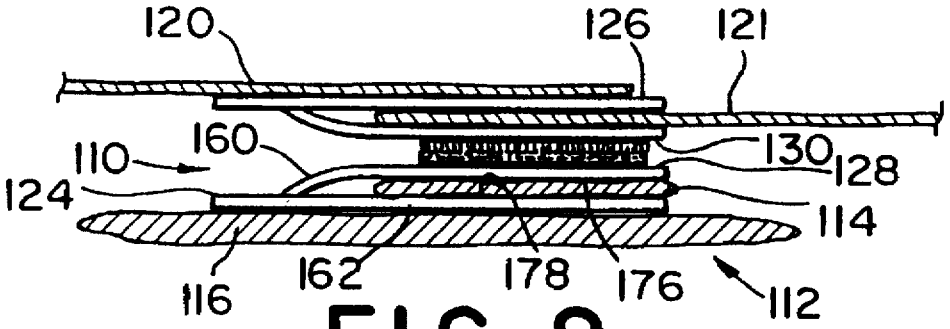
FIG. 9 is a top plan view of the necktie securing device in accordance with the second embodiment, shown in an engaged configuration.

Referring now to FIGS. 7–9, there is shown a second embodiment of a necktie securing device 110 comprising a first clip 124 and a second clip 126. The second embodiment of the necktie securing device 110 is similar to the first preferred embodiment of the necktie securing device 10 described above. The differences from the first embodiment are described in detail below.

As shown in FIGS. 7–9, the differences between the second embodiment of the necktie securing device 110 and the first embodiment of the necktie securing device 10 concern the structure of the first clip 124 and the second clip 126. The first clip 124 is constructed of a spring clip having a central prong 160, a first side prong 162 and a second side prong 164. The central prong 160 is preferably a substantially flat, generally rectangular member having a first joining surface 128 disposed on a first surface flat surface 161 and primarily extending in a direction parallel to the side prongs 162, 164. The first side prong 162 is preferably a substantially flat, rectangular member extending along a first edge 166 of the central prong 160 and the second side prong 164 is preferably a substantially flat, rectangular member extending along a second side edge 167 of the central prong 160. However, it is within the scope of the present invention to construct the central prong 160 and/or the side prongs 162, 164 having any other appropriate shape, such as, for example, substantially cylindrical (not shown).

Referring to FIG. 8, the first clip 124 may optionally include a cross-member 168, attached at a first end 167 to the first side prong 162 and at a second end 169 to the second side prong 164 and extending substantially perpendicular to the two side prongs 162, 164. Although in the preferred embodiment of the present invention, the first joining surface 128 is disposed on the central prong 160 as described above, it is within the scope of the present invention to dispose the first joining surface 128 on a flat surface of the cross-member 168.

A joint 172 extends substantially perpendicular to all three prongs and connects the central prong 160 to the first side prong 162 and the second side prong 164. Preferably, the joint 172 transmits a biasing moment on the central prong 160 and the two side prongs 162, 164 when there is an angular displacement of the central prong 160 with respect to the two side prongs 162, 164 about an axis 174 extending through the joint 172. The biasing moment acts to return the three prongs 160, 162, 164 of the first clip 124 to a configuration in which there is no relative angular displacement between the three prongs 160, 162, 164 about the axis 174.

Referring to FIGS. 7 and 9, when a portion of a necktie 112, preferably the tail 114, is placed in the opening formed when the central prong 160 is angularly displaced with respect to the side prongs 162, 164, the biasing moment causes a normal force to be exerted upon the tail 114 in a first direction from a grip surface 176 of the central prong 160 and to be exerted in a second, opposite direction from a grip surface 178 of the first side prong 162 and a grip surface 180 of the second side prong 164. These normal forces generate frictional forces which act to prevent relative movement between each grip surface 176, 178, 180 and the particular surface of the necktie 112 on which each grip surface 176, 178, 180 is placed and resists external forces, such as gravity, so that the first clip 124 remains attached to the necktie 112.

However, it within the scope of the present invention to construct the first clip 124 with a joint 172 which is incapable of exerting a biasing moment and thus, does not generate normal forces exerted from the prongs 160, 162, 164. With such a construction, the central prong 160 does not angularly displace with respect to the two side prongs 162, 164 and the first clip 124 is attached to the necktie 112 by weaving a side edge of the necktie 112 into the first clip 124 so that the central prong 160 is disposed on one side of the tail 114 of the necktie 112 and the two side prongs 162, 164 are disposed on an opposite, second side of the tail 114 of the necktie 112. The first clip 124 is then held to the necktie 112 solely by frictional forces acting between each portion of the tail 114 of the necktie 112 which extends beneath a section of the prongs 160, 162, 164, such that a portion of the weight of the first clip 124 is exerted upon the tail 114, and each such prong section arising due to the weight of the first clip 124.

Furthermore, it is within the scope of the present invention to construct the first clip 124 to have any other three-pronged spring clip configuration or to utilize any other type of force or moment and the source thereof by which the first clip 124 is capable of demountably attaching to a necktie 112. It is well within the abilities of one skilled in the art to construct a first clip 124 having any other appropriate means for attaching to a necktie utilizing any forces or moments as may be necessary for the particular clip configuration. The present invention is intended to embrace all such alternative three-pronged spring clip configurations.

Preferably, the central prong 160, the first side prong 162, the second side prong 164 and the joint 172 are constructed as an integral structure, with the three prongs extending from the same side of the joint 172. With an integral structure, the biasing force is generated by torsional stresses in the joint 172, and/or the bending stresses in the prongs 160, 162, 164, when the central prong 160 is angularly displaced about the axis 174 with respect to the side prongs 162, 164 or by bending stresses in the central prong 160 when it is displaced or a combination of both. However, it is within the scope of the present invention to construct the central prong 160, the first side prong 162, the second side prong 164 and the joint 172 as four separate members (not shown), with the biasing force provided by other means, such as a torsion spring (not shown) extending between the joint 172 and the central prong 160.

In the second preferred embodiment of the present invention, the second clip 126 is preferably substantially identical to the first clip 124 with the same structural differences from the first clip 124 as between the first clip 24 and the second clip 26 as discussed above in the first embodiment.

Referring to FIG. 9, a method of securing the necktie 112 to a shirt front 120 by utilizing the second preferred embodiment of the necktie securing device 110 is substantially identical to the method of securing the necktie 12 to the shirt front 20 utilizing the first preferred embodiment of a necktie securing device 10 with the following differences. The first clip 124 is attached to the tail 114 of the necktie 112 by disposing a portion of the tail 114 within the space formed when the central prong 160 is angularly displaced with respect to the side prongs 162, 164 and a section of the tail 114 is disposed over the grip surface 176 of the central prong 160, the grip surface 178 of the first side prong 162 and the grip surface 180 of the second side prong 164. Alternatively, the first clip 124 is attached to the label 18. The second clip 126 is attached to the overlapping edge 121 of the shirt front 120 in a substantially similar manner.

It will be understood by those of ordinary skill in the relevant art that a combination of the first preferred embodiment of the necktie securing device 10 and the second preferred embodiment of the necktie securing device 110 may be used.

All of the disclosed embodiments of the present invention have a number of advantages over the prior art devices for securing a necktie to a shirt front. The necktie securing device 10, 110 can be readily attached or detached from the necktie 12 and the shirt front 20 and the location of the device on both the necktie 12 and the shirt front 20 is easily adjusted. Further, the necktie securing device 10, 110 can be placed at a plurality of locations on the shirt front 20 or the necktie 12 and does not require any particular portion or feature of either the shirt front 20 or the necktie 12 for attachment. Finally, the necktie securing device 10, 110 does not cause any damage to either the shirt front 20 or the necktie 12. No prior art device for securing a necktie to a shirt front has all three of the advantages discussed above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A necktie securing device for securing to a shirt front a necktie having a tail, an apron and a label, said label being attached to a rear surface of said apron when said tail is disposed within an opening formed between said label and said apron, said device comprising;

a first clip demountably attachable to said tail and having a first joining surface, the first clip including a vertical joint and three spaced horizontal prongs extending from one side of the joint, the first joining surface being disposed on one of the prongs; and a second clip demountably attachable to an overlapping edge of said shirt front and having a second joining surface, the second clip including a vertical joint and three spaced horizontal prongs extending from one side of the joint, the second joining surface being disposed on one of the prongs, the second joining surface of the second clip being releasably engageable with the first joining surface of the first clip to secure the first clip to the second clip, wherein the first clip and the second clip are substantially identical so as to be interchangeable in attachment position, and the first and second joining surfaces are disposed on the same prong of their respective clips so as to mate with each other.

2. The device as recited in claim 1, wherein one of the first joining surface and the second joining surface includes a plurality of hook elements and the other of the first joining surface and the second joining surface includes a plurality of loop elements, said hook elements being configured to engage said loop elements.

3. The device as recited in claim 1, wherein the first clip and the second clip are hidden from view when in an operative position.

4. A necktie securing device for securing to a shirt front a necktie having a tail, an apron and a label, the label being attached to a rear surface of the apron when the tail is disposed within an opening formed between the label and the apron, the device comprising:

a first clip demountably attachable to the tail and having a first joining surface, the first clip including a vertical joint, three spaced horizontal prongs extending from one side of the joint, and a cross-member attached at a first end to the first and third horizontal prongs, the first joining surface being disposed on the cross-member; and a second clip demountably attachable to an overlapping edge of the shirt front and having a second joining surface, the second clip including a vertical joint, three spaced horizontal prongs extending from one side of the joint, and a cross-member attached at a first end to the first and third horizontal prongs, the second joining surface being disposed on the cross-member, the second joining surface of the second clip being releasably engageable with the first joining surface of the first clip to secure the first clip to the second clip, wherein the first clip and the second clip are substantially identical so as to be interchangeable in attachment position, and the first and second joining surfaces are disposed on the cross-member of their respective clips so as to mate with each other.

* * * * *

UNITED STATES PATENT AND TRADEMARK OFFICE

CERTIFICATE OF CORRECTION

PATENT NO. : 5,715,538

DATED : February 10, 1998

INVENTOR(S) : David B. Soll

It is certified that error appears in the above-indentified patent and that said Letters Patent is hereby corrected as shown below:

On title page, item [54] and col. 1, lines 1-2,

In the Title:

Delete the original title in its entirety and replace it with the following new title: --DEVICE FOR SECURING A NECKTIE TO A SHIRT FRONT--.

Item [56]

In the "References Cited" portion of the patent, add the following U.S. Patents to the listing of US. Patent Documents:

| | | |
|---|---|---|
| -- 1,273,261 | 7/1918 | Mills, Jr. |
| 1,291,090 | 1/1919 | Nuzum |
| 1,644,863 | 10/1927 | Weisbaum |
| 1,751,963 | 3/1930 | Weinschreider |
| 1,960,145 | 5/1934 | Edelheit |
| 2,006,427 | 7/1935 | Wolfson |
| 2,389,784 | 11/1945 | Kennedy |
| 2,588,576 | 3/1952 | Roop et al. |
| 2,652,569 | 9/1953 | Confino |
| 2,746,055 | 5/1956 | Gleason |

UNITED STATES PATENT AND TRADEMARK OFFICE

CERTIFICATE OF CORRECTION

PATENT NO. : 5,715,538

DATED : February 10, 1998

INVENTOR(S) : David B. Soll

It is certified that error appears in the above-indentified patent and that said Letters Patent is hereby corrected as shown below:

| | | |
|---|---|---|
| 3,042,983 | 7/1962 | Riedler |
| 3,613,117 | 10/1971 | Gingerich |
| 3,639,916 | 2/1972 | Vaughn |
| 4,631,752 | 12/1986 | Heyman et al. |
| 4,827,536 | 5/1989 | Sung |
| 4,827,576 | 5/1989 | Prince, Jr. |
| 4,835,821 | 6/1989 | Durante |
| 4,920,579 | 5/1990 | Swain |
| 4,972,523 | 11/1990 | Begg |
| 5,073,987 | 12/1991 | Crosier |
| 5,095,546 | 3/1992 | Jones |
| 5,109,547 | 5/1992 | Abdallah |

UNITED STATES PATENT AND TRADEMARK OFFICE

CERTIFICATE OF CORRECTION

PATENT NO. : 5,715,538

DATED : February 10, 1998

INVENTOR(S) : David B. Soll

It is certified that error appears in the above-indentified patent and that said Letters Patent is hereby corrected as shown below:

| | | |
|---|---|---|
| 5,239,707 | 8/1993 | Pileggi |
| 5,315,713 | 5/1994 | Pileggi-- |

Signed and Sealed this

Fourteenth Day of July, 1998

Bruce Lehman

*Attest:*

BRUCE LEHMAN

*Attesting Officer*

*Commissioner of Patents and Trademarks*